United States Patent [19]

Abe et al.

[11] Patent Number: 4,596,306

[45] Date of Patent: Jun. 24, 1986

[54] EXHAUST SILENCING SYSTEM

[75] Inventors: Takeshi Abe, Machida; Yuuzi Aoki, Atsugi, both of Japan

[73] Assignee: Nissan Motor Co., Ltd., Japan

[21] Appl. No.: 597,114

[22] Filed: Apr. 5, 1984

[30] Foreign Application Priority Data

Apr. 12, 1983 [JP] Japan ..... 58-54454[U]
Apr. 12, 1983 [JP] Japan ..... 58-54455[U]

[51] Int. Cl.[4] ..... F01N 1/24

[52] U.S. Cl. ..... 181/228; 181/252; 181/256

[58] Field of Search ..... 181/227, 228, 252, 256, 181/258, 248; 428/566

[56] References Cited

U.S. PATENT DOCUMENTS 2,308,607 1/1943 Jackson ..... 181/227 X
2,913,870 11/1959 Lashley ..... 181/228 X
3,752,260 8/1973 Heath ..... 181/228
3,955,643 5/1976 Clark ..... 181/248
4,283,465 4/1981 Morimoto et al. ..... 428/566
4,413,657 11/1983 Sasaki et al. ..... 181/227 X

FOREIGN PATENT DOCUMENTS 42017 5/1933 France ..... 181/250
56-154514 4/1981 Japan .
56-22412 8/1981 Japan .

*Primary Examiner*—Benjamin R. Fuller
*Attorney, Agent, or Firm*—Lowe, Price, Leblanc, Becker & Shur

[57] ABSTRACT

An exhaust silencing system for an automotive engine comprises a sound absorbing tube formed of a gas permeable porous material and connected at its one end with a tailpipe of an exhaust system of the engine, thereby effectively attenuating exhaust noise, particularly in a high frequency range.

14 Claims, 15 Drawing Figures

EXHAUST SILENCING SYSTEM

BACKGROUND OF THE INVENTION

1. Field of the Invention

This invention relates in general to an exhaust silencing system for an automotive internal combustion engine, and more particularly to a exhaust silencing system that also attenuates exhaust noise in a high frequency range.

2. Description of the Prior Art

Automotive engines are provided with an exhaust silencing system incorporated within an exhaust system through which engine exhaust gas is discharged to ambient air. The exhaust sliencing system is in general composed of a plurality of mufflers connected to exhaust pipe and installed under the floor of a vehicle body, so that exhaust noise is attenuated by the mufflers. However, these mufflers are arranged to attenuate mainly exhaust noises in medium and low frequency ranges, and therefore noise in a high frequency range such as jet noise is unavoidably emitted to ambient air.

SUMMARY OF THE INVENTION

An exhaust silencing system of the present invention is composed of a sound absorbing tube formed of a gas permeable porous material and connected at its one end with a tailpipe of an exhaust system of an automotive internal combustion engine. The other end of the sound absorbing tube remains open. The inner diameter of the sound absorbing tube is generally equal to that of the tailpipe. Accordingly, exhaust noise, particularly in a high frequency range, passed through mufflers is effectively attenuated by the sound absorbing tube which effects sound absorption and diffusion of the gas passing therethrough.

BRIEF DESCRIPTION OF THE DRAWINGS

The features and advantages of the exhaust silencing system of the present invention will be more clearly appreciated from the following description taken in conjunction with the accompanying drawings in which like reference numerals designate corresponding elements, and in which.

DETAILED DESCRIPTION OF THE INVENTION

Figure 1:
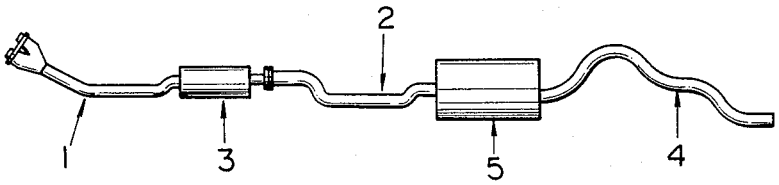
FIG.1 (PRIOR ART)
FIG. 1 is a schematic illustration of a conventional exhaust silencing system.

Referring to FIG. 1, a conventional exhaust silencing system of an automotive internal combustion engine will be described along with its major short-comings. Such an exhaust silencing system includes a pre-muffler 3 disposed between a front pipe 1 and a center pipe 2. In addition, a main-muffler 5 is provided between the front pipe 2 and a tailpipe 4. The pre-muffler 3 is relatively small-sized and arranged to silence exhaust sound under the effect of acoustic resonance, while the main-muffler is relatively large-sized to have many chambers therein and arranged to silence the exhaust sound under the mutual effect of acoustic resonance and gas expansion.

However, such an exhaust silencing system has encountered the following problems: The above-mentioned pre-muffler 3 and the main-muffler 5 are constructed to reduce the sound levels of low and medium frequencies, and therefore a sufficient reduction effect has not been obtained for the sound level of the high frequencies. If the inner diameter of the tailpipe is enlarged to reduce the high frequency components of exhaust gas flow noise, the reduction effect of low frequency components deteriorates, thereby increasing noise within a passenger compartment.

Otherwise, it has been proposed for the purpose of reducing exhaust noise in a high frequency range that a sound absorption member made of a porous material is provided in an exhaust pipe in a manner to close the exhaust pipe. However, this unavoidably increases exhaust system back pressure, thus largely degrading engine power output performance.

Figure 2:
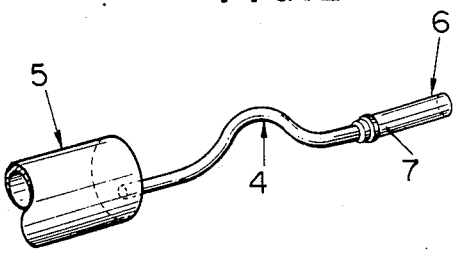
FIG. 2 is a perspective view showing an essential part of a first embodiment of an exhaust silencing system according to the present invention.
Figure 3:
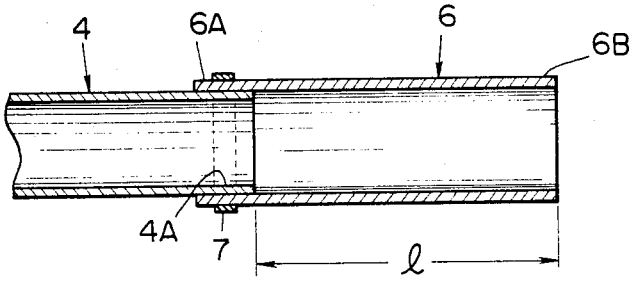
FIG. 3 is an enlarged longitudinal sectional view of an essential part of the system of FIG. 2.

In view of the above description of the conventional exhaust silencing system, reference is now made to FIGS. 2 to 13, and more specifically to FIGS. 2 and 3, wherein a first embodiment of an exhaust silencing system of the present invention is illustrated. The exhaust silencing, system comprises a sound absorbing tube 6 added to the arrangement of FIG. 1. The sound absorbing tube 6 is formed of a gas permeable porous material through which air can flow. The sound absorbing tube 6 is connected at its front end section 6A with rear free end section 4A of a tailpipe 4 of an exhaust system of the internal combustion engine, so that a rear section 6B, of the sound absorbing tube 6 remains open to ambient air. The sound absorbing tube 6 is cylindrical and has a predetermined length, for example, of about 170 mm.

The connection of the sound absorbing tube 6 with the tailpipe is made so that the tailpipe end section 4A overlaps the front end section of the sound absorbing tube 6, and the thus lapping sound absorbing tube front end section 6A is fastened with a fastening member 7 such as a C-shaped clamp or the like.

Accordingly, although the inner diameter of the sound absorbing tube 6 is greater than that of the tailpipe 4 by an amount of the thickness of the tailpipe 4, the inner diameters of them are considered to be generally the same because the thickness of the tailpipe 4 is usually considerably small. In this connection, the thickness of the tailpipe 4 is, in this instance, within a range from 1 to 10 mm, preferably from 2 to 4 mm. The above-mentioned porous material is resistant to a temperature of 500° C. or higher and to the state of PH 8-4. The porous material is, for example, a sintered porous product of aluminium powder or the like, a porous ceramic product, or wire netting of a single layer or multiple layers. The porous material in this instance has a porosity within a range from 10 to 90%, preferably from 30 to 60%. It will be understood that the other arrangement of the exhaust silencing system of the present invention is the same as in the conventional one shown in FIG. 1 and therefore the detailed explanation thereof is omitted for the purpose of simplicity of illustration.

With the thus arranged exhaust silencing system, exhaust noise of high frequencies have not been attenuated by the pre-muffler 3 and the main-muffler 5 to be emitted from the tailpipe rear end section 4A as jet noise. However, in this embodiment, the gas permeable porous material of the sound absorbing tube 6 functions to acoustically absorb sound to make sound attenuating effect under the action of friction, small expansion, contraction and the like of exhaust gas, in which the reflection of the exhaust noise is repeated on the inner surface of the sound absorbing tube 6, thereby absorbing and attenuating the exhaust noise.

Figure 14A:
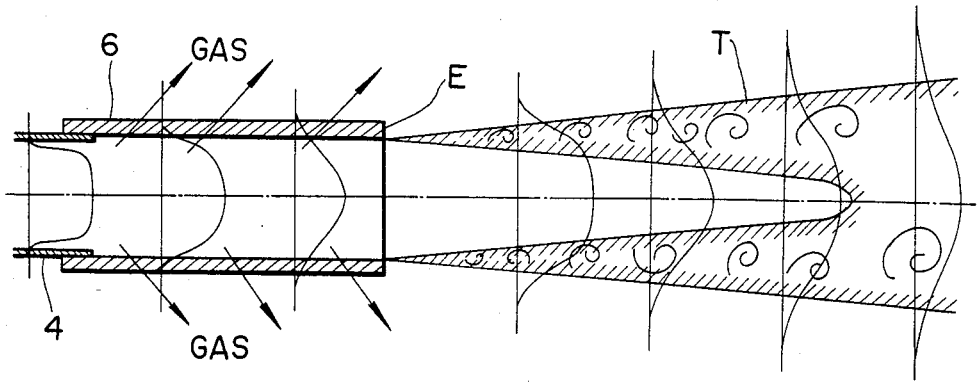
FIG. 14A is a diagram showing the velocity distribution of gas in case of the present invention.
Figure 14B:
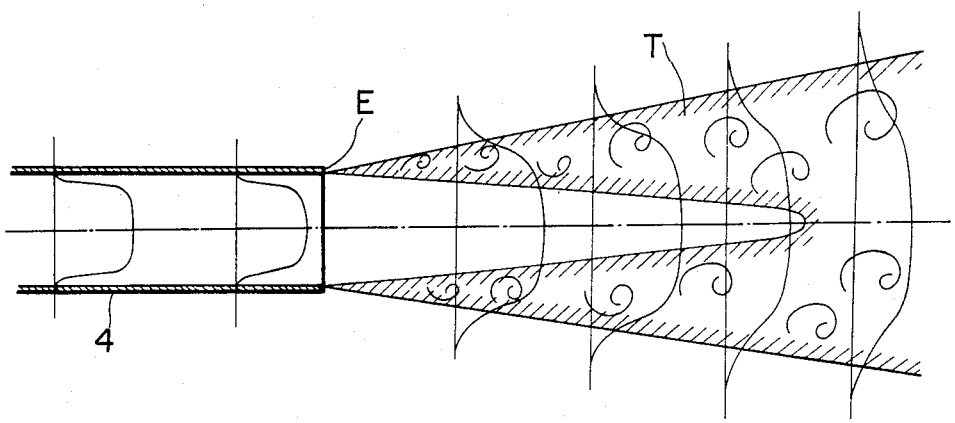
FIG. 14B is a diagram similar to FIG. 14A, but showing velocity distribution of gas in a conventional case.

In addition, since the sound absorbing tube 6 has a high gas permeability, a part of exhaust gas is dissipated through the sound absorbing tube 6, so that a boundary layer to be formed on the inner wall surface of the sound absorbing tube 6 due to the viscosity of gas is gradually diminished. As a result, the velocity distribution or profile of gas in the sound absorbing tube 6 is flatten, and accordingly the maximum flow velocity as well as the velocity gradient of jet T generated downstream of an exhaust outlet E is considerably reduced as illustrated in FIG. 14A which shows the velocity distribution of gas in case (with the sound absorbing tube 6) of the present invention, thereby reducing the volume of noise source which is caused by turbulent jet T (in FIG. 14A) generated downstream of the exhaust outlet E. Furthermore, the gas permeability of the porous material causes heat dispersion effect which lowers gas temperature and flow velocity. This smoothes exhaust pulsation, thereby contributing to a considerable decrement in low frequency components or engine firing components. In this connection, the velocity distribution of gas in a conventional case (without the sound absorbing tube 6) such as shown in FIG. 1 is illustrated in FIG. 14B for comparison. It will be understood that no back pressure rise occurs because the sound absorbing tube 6 never closes up the tailpipe rear end 4A through which the exhaust gas is discharged out of the exhaust system.

Figure 4:
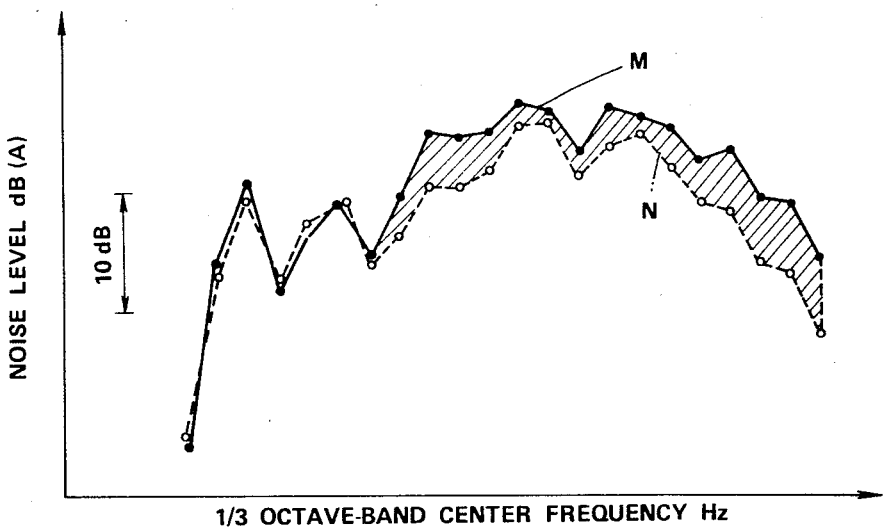
FIG. 4 is a graph showing the comparison in noise attenuating effect between the conventional exhaust silencing system and the exhaust silencing system according to the present invention.

FIG. 4 depicts experimental data showing the comparison in noise attenuating performance between the conventional exhaust silencing system (without the sound absorbing tube 6) as shown in FIG. 1 and the first embodiment exhaust silencing system (with the sound absorbing tube 6) of the present invention. A solid line M indicates the data of the conventional exhaust silencing system while a broken line N indicates the data of the exhaust silencing system of the present invention. The graph in FIG. 4 reveals the fact that exhaust noise in a high frequency range is noticeably attenuated under the effect of the sound absorbing tube 6 as indicated by a hatched section.

Figure 5:
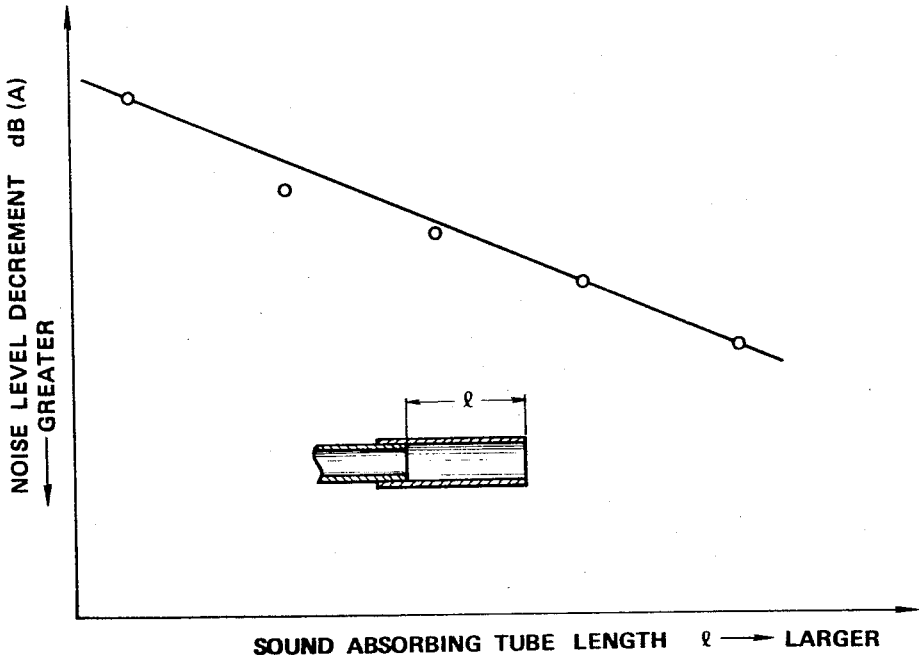
FIG. 5 is a graph showing the relationship between noise level decrement and the length of a sound absorbing tube of the system of FIG. 2.

FIG. 5 depicts the experimental data of the noise level decrement in the length l of the sound absorbing tube 6. The graph in FIG. 5 shows the fact that the noise attenuating effect becomes greater with the increased length of the sound absorbing tube 6. This leads to a conclusion that it is advantageous for noise attenuation to make the length of the sound absorbing tube 6 as large as possible.

Figure 6:
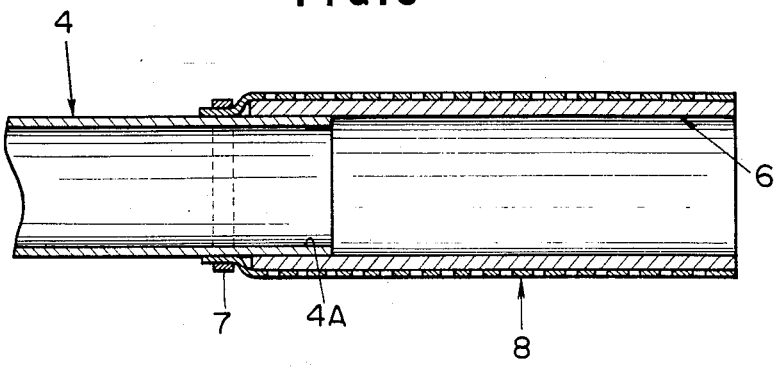
FIG. 6 is a longitudinal sectional view of an essential part of a second embodiment of the exhaust silencing system according to the present invention.
Figure 7:
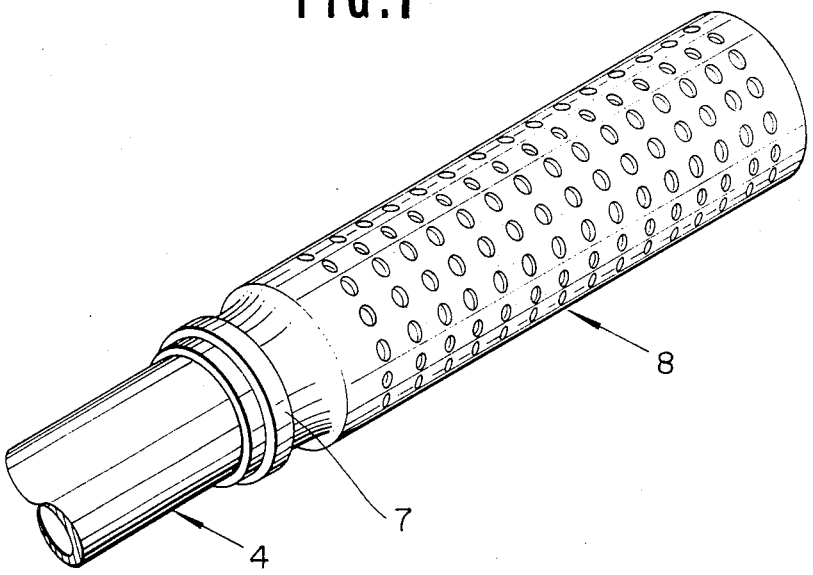
FIG. 7 is a perspective view of the essential part of FIG. 6.

FIGS. 6 and 7 show a second embodiment of the exhaust silencing system of the present invention, in which the sound absorbing tube 6 is covered with a cylindrical perforated tube 8 formed of a perforated metal sheet in order to improve the installation strength and the appearance of the sound absorbing tube 6. In this embodiment, the fastening member 7 is disposed around a front end section of the perforated tube 8.

Figure 8:
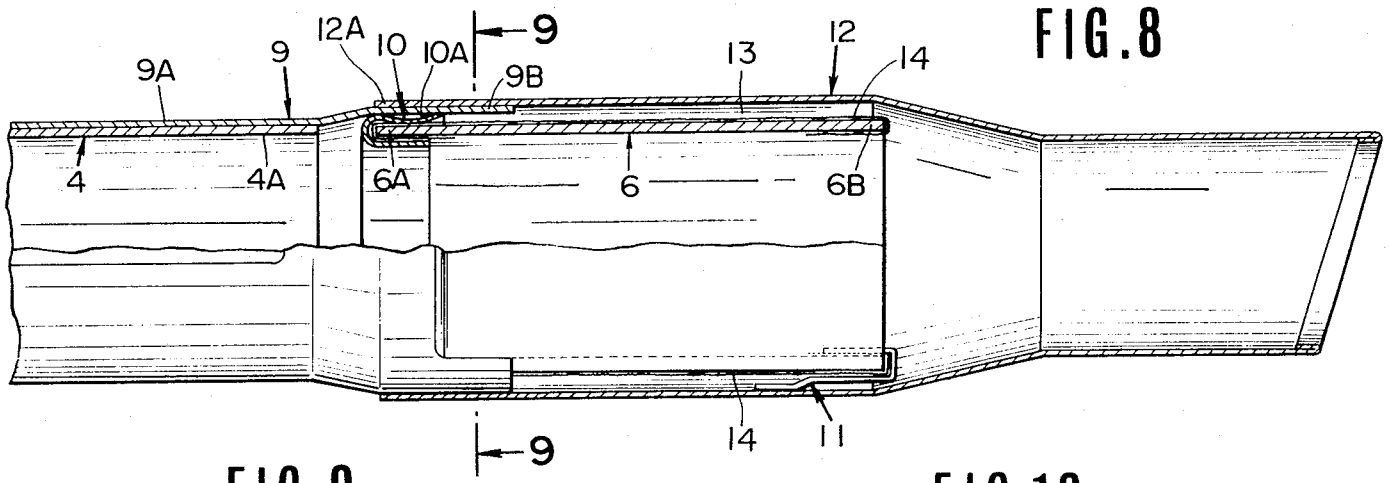
FIG. 8 is a longitudinal sectional view of an essential part of a third embodiment of the exhaust silencing system according to the present invention.
Figure 10:
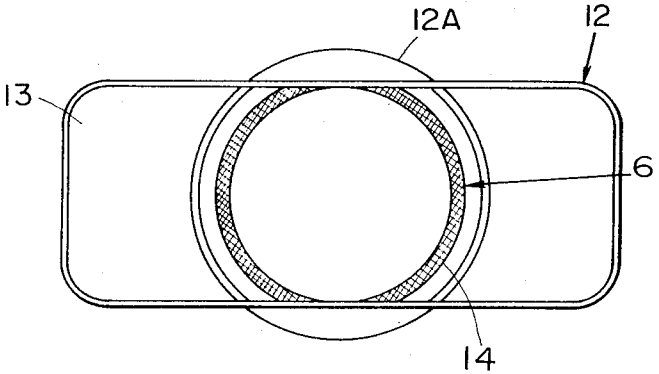
FIG. 10 is a side elevation of FIG. 8 as viewed from the direction of the rear of the system of FIG. 8.
Figure 9:
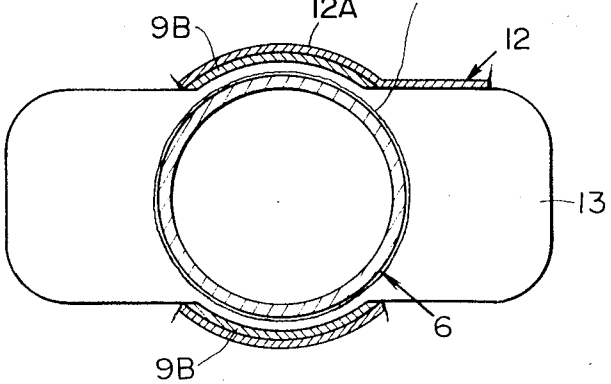
FIG. 9 is a sectional view taken along the line 9—9 of FIG. 8.

FIGS. 8, 9 and 10 show a third embodiment of the exhaust silencing system according to the present invention. In this embodiment, a connector 9 is fittingly connected at its front end section 9A with the rear end section 4A of the tailpipe 4. The connector 9 is formed cylindrical at its front end section 9A, and its diameter is slightly widened at the rear end section 9B which is bifurcated so that the opposite side portions of the connector rear end section 9B are cut out. An annular metal installation member 10 having a C-shaped cross-section is secured on the inner surface of the connector rear end section 9B, for example, by welding. As shown, the front end section 6A of the sound absorbing tube 6 is fitted into the installation member 10 and securely supported in position. In this instance, the outer plate section 10A of the installation member 10 is so inwardly bent as to project toward the sound absorbing tube 6 in order to elastically support the sound absorbing tube 6 relative to the inner surface of the connector 9. In other words, the installation member 10 is supplied with a spring function. The outer surface of the sound absorbing tube 6 is covered with wire netting 14 in such a manner that the both end sections 6A, 6B are wrapped in the wire netting 14.

The rear end section 6B of the sound absorbing tube 6 is fitted into and securely supported by two hook-shaped metal installation members 11 which are respectively fixed at lower two portions of the inner surface of an outer tube 12, for example, by welding. Each installation member 11 has a spring function so as to elastically support the sound absorbing tube 6 relative to the inner surface of the outer tube 12. The outer tube 12 is securely connected to the connector 9 by welding in such a manner that the rear end section 9B of the connector 9 is lapped in the front end section 12A of the outer tube 12. It will be seen that the inner diameter of the sound absorbing tube 6 is generally the same as that of the tailpipe 4, while the outer tube 12 is formed generally rectangular in cross-section as shown in FIG. 9, so that an air gap 13 is defined between the outer surface of the sound absorbing tube 6 and the inner surface of the outer tube 12. The air gap 13 is relatively thin at its upper and lower sections which are respectively defined in an upper clearance between the upper portion of the sound absorbing tube 6 and the upper portion of the outer tube 12 and a lower clearance between the lower portion of the sound absorbing tube 6 and the lower portion of the outer tube 12, while it is relatively thick at its opposite side sections which are respectively defined in opposite side clearances each of which is between the side portion of the sound absorbing tube 6 and the side portion of the outer tube 12. Additionally, in this embodiment, the sound absorbing tube 6 is elastically supported as stated above in order to prevent the damage due to the tendency of thermal deformation particularly in case where the sound absorbing tube 6 is formed cylindrical by combining two semicylindrical counterparts each of which has already been prepared from a plate type porous material.

Figure 11:
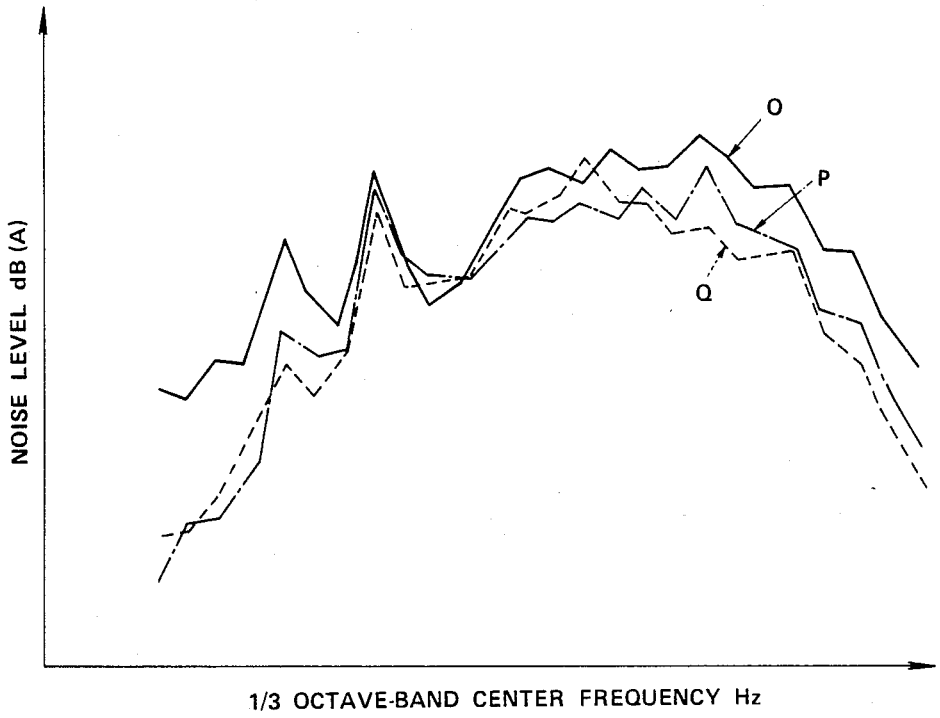
FIG. 11 is a graph showing the comparison in noise attenuating effect among the conventional exhaust silencing system, and the first and third embodiments of the present invention.

In operation of the exhaust silencing system of FIGS. 8, 9 and 10, the high frequency exhaust noise can be effectively attenuated under the effect of the sound absorbing tube 6 as same as in the first embodiment of FIGS. 2 and 3. Additionally, the air gap 13 defined in the clearance between the sound absorbing tube 6 and the outer tube 12 effectively attenuates noises in various frequency ranges corresponding to the various sections of the clearance which noises have passed through the sound absorbing tube 6. As a result, noise attenuation effect is made throughout a wide frequency range as shown in FIG. 11 where a solid line O indicates the data of the conventional exhaust silencing system (without the sound absorbing tube 6) as shown in FIG. 1; a dot-and-dash line P indicates the data of the exhaust silencing system (with the sound absorbing tube 6) as shown in FIGS. 2 and 3; and a broken line Q indicates the data of the exhaust silencing system (with the sound absorbing tube 6 and the outer tube 12) as shown in FIGS. 8, 9 and 10. The graph in FIG. 11 reveals that the embodiment of FIGS. 8, 9 and 10 is improved in exhaust noise attenuating effect in a wide frequency range even over the embodiment of FIGS. 2 and 3 and of course over the conventional exhaust silencing system. In addition, the experiments revealed that, in the embodiment of FIGS. 8, 9 and 10, the noise attenuating effect of the sound absorbing tube 6 becomes greater as the length of the tube 6 is increased as same as in the embodiment FIGS. 2 and 3 and as shown in FIG. 5.

Furthermore, the embodiment of FIGS. 8, 9 and 10 is of the double-tube construction functions also as a diffuser, thereby effectively lowering the temperature of the exhaust gas. This prevents the baneful influence due to the discharge of high temperature exhaust gas. Besides, since the sound absorbing tube 6 never closes up the discharge outlet 4A of the tailpipe 4, so that the exhaust system back pressure does not rise.

While the outer tube 12 has been shown to be opened forward or in the direction of the tailpipe 4 in this embodiment, it will be understood that the outer tube 12 may be closed at its front section 12A.

Figure 12:
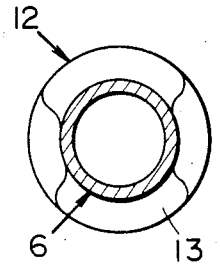
FIG. 12 is a sectional view similar to FIG. 9, but showing an essential part of a fourth embodiment of the exhaust ilencing system according to the present invention.
Figure 13:
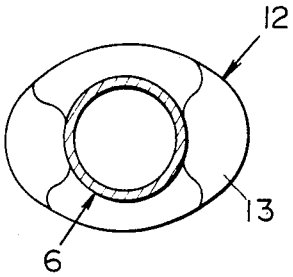
FIG. 13 is a sectional view similar to FIG. 9, but showing an essential part of a fifth embodiment of the exhaust silencing system according to the present invention.

FIGS. 12 and 13 show fourth and fifth embodiments of the exhaust silencing systems according to the present invention, respectively, which are similar to the third embodiment of FIGS. 8, 9 and 10 except for the cross-sectional shape of the outer tube 12. The cross-sectional shape of the outer tube 12 is such different from the third embodiment that the volume of the air gap 13 is varied to be intended to attenuate exhaust noise in a further wide frequency range. The embodiment of FIG. 12 is provided with the outer tube 12 which is disposed coaxial with the sound absorbing tube 6, thereby attenuating a certain frequency component. The embodiment of FIG. 13 is provided with the outer tube 12 whose cross-section is oval to attenuate frequency components within a certain frequency range.

As appreciated from the above discussion, according to the present invention, the rear end section of the tailpipe of the exhaust system is provided with the sound absorbing tube which is formed of the porous material and whose inner diameter is generally the same as that of the tailpipe. The sound absorbing tube effects the acoustic sound absorbing action thereinside serving as a sound absorbent and the diffusion action of the gas stream therewithin, thereby effectively attenuating the jet noise or the high frequency noise generated at the rear of the tailpipe without raising the exhaust system back pressure. In addition, if the outer cover is further provided to surround the sound absorbing tube forming a space therebetween, various noises in a wide frequency range can be effectively attenuated in addition to the exhaust noise in the high frequency range.

What is claimed is:

1. An exhaust silencing system for an automotive internal combustion engine, comprising:

a sound absorbing tube formed of an inherently gas permeable porous material having first and second opposite end sections, said sound absorbing tube being connected at the first end section with the rear end of a tailpipe of an exhaust system of the engine, the second end section of said sound absorbing tube remaining open, said sound absorbing tube having an inner diameter substantially equal to or greater than that of the tailpipe, said porous material having the characteristic of absorbing and attenuating exhaust noise including high frequency exhaust noise by permitting a portion of exhaust gas traveling through pores of the tube forming an inherent characteristic of the tube material to be dissipated through the porous material of said tube so that a boundary layer tending to be formed on an inner wall surface of said tube due to gas viscosity is attenuated so that a maximum flow velocity and velocity gradient of a resulting jet generated downstream of an exhaust outlet defined by said second end section is reduced to a level lower than the noise level of exhaust gases discharged into ambient atmosphere directly from a tailpipe formed without said sound absorbing tube.

2. An exhaust silencing system as claimed in claim 1, further comprising an outer tube disposed around said sound absorbing tube maintaining a space between the outer surface of said sound absorbing tube and the inner surface of said outer tube.

3. An exhaust silencing system as claimed in claim 1, wherein said porous material is one selected from the group consisting of a sintered product of metal powder, a ceramic material, and a wire netting.

4. An exhaust silencing system as claimed in claim 1, wherein said porous material has a porosity ranging from 10 to 90%.

5. An exhaust silencing system as claimed in claim 1, wherein said sound absorbing tube has a thickness ranging from 1 to 10 mm.

6. An exhaust silencing system as claimed in claim 1, wherein said sound absorbing tube has a length of about 170 mm.

7. An exhaust silencing system as claimed in claim 1, further comprising a perforated tube disposed around and in contact with said sound absorbing tube.

8. An exhaust silencing system as claimed in claim 1, further comprising a muffler fluidly connected to the engine and disposed upstream of said tailpipe, said muffler being connected with said tailpipe.

9. An exhaust silencing system for an automotive internal combustion engine, comprising:

a sound absorbing tube formed of a gas permeable porous material and having first and second end sections which are opposite each other, said sound absorbing tube being connected at the first end section with a tailpipe of an exhaust system of the engine, the second end section of said sound absorbing tube remaining opened, said sound absorbing tube having an inner diameter substantially equal to or more than that of the tailpipe, further comprising an outer tube disposed around said sound absorbing tube maintaining a space between the outer surface of said sound absorbing tube and the inner surface of said outer tube, further comprising a connector tube having first and second end sections which are opposite each other, said connector tube being connected at its first end section with an end section of said tailpipe, and connected at its second end section with said sound absorbing tube.

10. An exhaust silencing system as claimed in claim 9, wherein said sound absorbing tube is supported on the inner surface of said connector tube, in which said outer tube is connected to said connector tube in a manner that a part of the second end section of said connector tube is lapped in said outer tube.

11. An exhaust silencing system as claimed in claim 10, further comprising means for elastically supporting said sound absorbing tube on the inner surface of said connector tube.

12. An exhaust silencing system as claimed in claim 11, wherein said elastically supporting means includes a first fixing member having a spring function and securely attached on the inner surface of said connector tube, said first fixing member gripping an end edge of said sound absorbing tube first end section, and a second fixing member having a spring function and securely attached to the inner surface of said outer tube, said second fixing member gripping an end edge of said sound absorbing tube second end section.

13. An exhaust silencing system as claimed in claim 10, the second end section of said connector tube is larger in inner diameter than the first end section of said connector tube, in which the first end section of said sound abosrbing tube is disposed inside the second end section of said connector tube so that the inner diameter of said sound absorbing tube is equal to that of said tailpipe.

14. An exhaust silencing system as claimed in claim 13, said outer tube extends over the end edge of the second end section of said sound absorbing tube in the direction in which exhaust gas is discharged.

* * * * *